United States Patent [19]

Cusack et al.

[11] Patent Number: 4,979,420

[45] Date of Patent: Dec. 25, 1990

[54] STAINLESS STEEL REED

[76] Inventors: John F. Cusack, 169 E. Rienstra St., Chula Vista; Gerald H. Finch, 3202 Caminito Quixote, San Diego, both of Calif. 92154

[21] Appl. No.: 468,085

[22] Filed: Jan. 22, 1990

[51] Int. Cl.[5] ..... G10D 9/02

[52] U.S. Cl. ..... 84/383 A

[58] Field of Search ..... 84/383 R, 383 A

[56] References Cited

U.S. PATENT DOCUMENTS

| | | | |
|---|---|---|---|
| 1,133,868 | 3/1915 | Lynn | 84/383 A |
| 1,616,748 | 2/1927 | Horton | 84/383 A |
| 1,667,836 | 5/1928 | Brockman, Jr. | 84/383 A |
| 1,783,824 | 12/1930 | Brenner | 84/383 A |
| 2,375,934 | 5/1945 | Lucas | 84/383 A |
| 3,420,132 | 1/1969 | Backus | 84/383 A |

FOREIGN PATENT DOCUMENTS

| | | | |
|---|---|---|---|
| 20385 | 9/1902 | United Kingdom | 84/383 A |

*Primary Examiner*—Lawrence R. Franklin

*Attorney, Agent, or Firm*—Brown, Martin, Haller& McClain

[57] ABSTRACT

A stainless steel reed is formed by cutting a strip of full-hard stainless. A rounded edge is formed at the tongue end of the strip which is then tapered toward the tongue end by friction extraction of material from the lower surface to form a wedge. Additional material is removed from the central portions of the lower side of the tongue end to create a generally concave depression. Material remaining around the perimeter of the depression acts as supports for the thin center section created by the concave depression, permitting harmonic vibration in the center section while maintaining adequate strength.

A method of forming a stainless steel reed includes cutting strips of full-hard stainless steel to fit the mouthpiece of the instrument. The tongue end of the strip is rounded and the lower surface is tapered toward the tongue end by friction extraction. A concave depression is created in the tongue end by friction extraction.

16 Claims, 1 Drawing Sheet

STAINLESS STEEL REED

BACKGROUND OF THE INVENTION

I. Field of the Invention

The present invention relates to metal reeds for wind instruments and a method for making such reeds, and more specifically to stainless steel reeds.

II. Description of Related Art

Most woodwind instruments are played by blowing air past one or more reeds in the mouthpiece which then vibrate, producing a musical tone. The reed for these instruments has historically been made of cane, which is of sufficient stiffness to produce the desired vibratory response, but which is also very delicate and subject to breaks, splits, molecular breakdown due to vibration and from the body acids to which it is subjected. An additional drawback to the cane reed is that disinfecting the reed is difficult, due both to its porosity and the fact that it must be kept moist to avoid cracking. On the other hand, an overly moistened reed loses elasticity and, therefore, does not vibrate as needed to produce the desired tones. Finally, the delicate nature of reeds has prevented blind and vision impaired music students from learning to play most woodwinds. Reeds require almost constant attention to maintain. For a blind student, inserting, checking and adjusting the reed means touching and usually breaking it.

Many attempts have been made to form a reed from plastic, plastic impregnated or fibrous-type material. These synthetic materials did not provide the same vibratory response as cane reeds.

Several early patents disclosed methods of making metal reeds for wind instruments which involved hammering the metal to thin and densify the tongue end of the reed (U.S. Pat. No. 1,133,868); or to grind or roll the tongue end to make it thinner (U.S. Pat. No. 1,616,748). A third patent describes cutting longitudinal grooves in the tongue to make the reed more elastic but still rigid (U.S. Pat. No. 1,667,836). None of the reeds described in these patents became commercially successful, however, and cane remains the favored reed for all woodwinds. The metal reeds did not have the vibratory response of cane due the ductile nature of the metal, so the instruments could not produce the desired tonal quality.

It would be desirable to have a reed which was durable and not subject to organic breakdown yet was capable of producing the optimal vibratory response which, until now, could be achieved only with cane reeds.

BRIEF SUMMARY OF THE INVENTION

The failure of prior art metal reeds to reproduce the vibratory response of cane reeds is due to the difference in their respective molecular structures. The key to enabling metal to vibrate the same as cane is to modify the molecular structure in such a way that the metal becomes denser and less flexible, even though it is very thin.

Stainless steel has long been an accepted material within the medical field for implantation in the human body. It is highly resistant to breakdown when exposed to organic compounds. Unless specially treated, however, a thin strip of stainless steel is too flexible to provide the necessary vibratory response for musical instruments.

The process of cold working stainless steel considerably magnifies surface hardness of sheets of steel. These sheets can be used to manufacture a reed for musical instruments which will duplicate the response of the cane reed without the undesirable delicate qualities of cane. Other processes which are capable of producing sheet stainless steel of similar hardness may also be used. Examples of such processes includes the use of paste metal which is processed using high pressure and high pressure molding of steel nuggets.

It is an advantage of the present invention to provide a new and improved stainless steel reed for wind instruments, and a method for making such reeds, which eliminates the need for use of delicate and difficult-to-handle cane reeds.

In an exemplary embodiment of the invention, a stainless steel reed is formed by cutting a strip of full-hard cold-work stainless. A rounded edge is formed at the tongue end of the strip which is then tapered by friction extraction of material from the lower surface to form a wedge. Additional material is removed from the central portions of the lower surface of the tongue end so that a concave depression is formed by dimpling of the metal induced by stress. Material remaining around the edge of the depression acts to support the thin center section, permitting reverberation of the center section and providing springiness to allow pitch control by varying pressure on the reed.

A method for producing a metal reed for wind instruments comprises cutting full-hard stainless steel into a strip where length and width are determined by the standard sizes of various musical instrument mouthpieces. A curved radius is formed in the tongue end of the strip to match the leading edge of the mouthpiece. A taper is formed in the tongue by friction extraction of material from the lower surface, with the taper beginning at the approximate lengthwise center of the strip and progressing toward the curved radius. A concave depression is formed in the tongue end by friction extraction. The machining performed during formation of the reed further hardens the stainless steel to permit the desired vibratory response.

BRIEF DESCRIPTION OF THE DRAWINGS

The present invention is best understood when referring to the drawing of which.

DETAILED DESCRIPTION OF THE INVENTION

Figure 1:
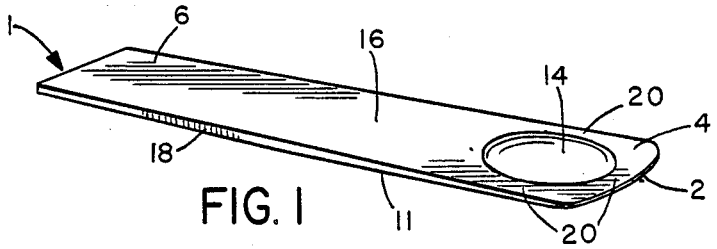
FIG. 1 is a perspective view of the stainless steel reed.
Figure 2:
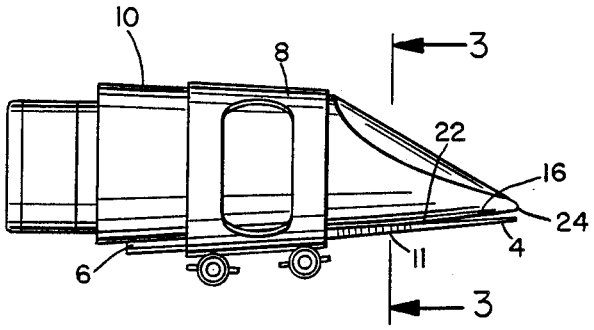
FIG. 2 is a side view of a reed attached to a mouthpiece.

Referring to FIGS. 1 and 2, the reed 1 is formed from a strip of full-hard stainless steel. The edge 2 of the strip is rounded to follow the contour of the mouthpiece. The base 6 of the reed 1 is held stationary, clamped to the mouthpiece 10 by a ligature 8 or similar clamp. The tongue 4 is formed by friction extraction of material from the lower surface 11 of the strip beginning at the approximate center 12 and tapering toward the edge, forming a thin vibrating tip. A concave depression 14 is formed in the upper surface 16 by friction extraction near the edge of the tongue 4. The depression 14 is inset sufficiently from the sides 18 of the strip so that the perimeter of the depression 14 is thicker and serves as a group of lateral supports 20 for the depression 14 in which vibration is induced.

The preparation of the stainless steel prior to forming the reed is critical for the successful operation of the reed. Full-hard cold-work stainless steel is sheet stainless steel which has been processed under extreme roll-form pressure until it has attained a high degree of hardness on both sides. This hardness is accomplished by a combination of elongating the grains of metal and disrupting the molecular structure within each grain, a phenomenon termed "strain hardening". It is this hardness that causes the cold-work stainless steel to have the requisite vibratory response to duplicate the response of cane reeds. The material used should have a hardness rating of approximately C-41 as determined by the Rockwell hardness test using a diamond penetrator.

Alternatively, strips of full hard stainless steel may be obtained by subjecting paste metal to high pressure on the order of 3600 p.s.i. with subsequent sintering; or solid nuggets of soft stainless steel may be molded into strips using high pressure to create full-hard stainless.

Blanks for forming stainless steel reeds are cut from the cold-rolled steel sheets according to the standard sizes of the various musical instrument mouthpieces. The edge 2 of the strip is rounded to conform to the curvature of the leading edge of the appropriate mouthpiece.

Figure 4:
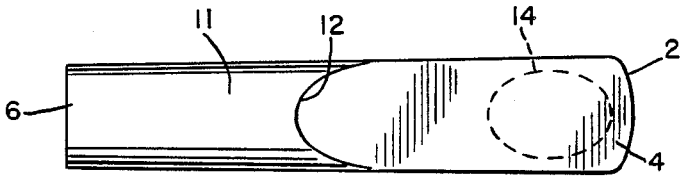
FIG. 4 is a plan view of the lower surface of the reed.

The taper which permits vibration of the reed is formed by friction extraction of material from the lower surface 11 of the strip. Friction extraction processes include grinding, cutting and electro-discharge machining (EDM). The taper begins at the approximate lengthwise center 12 of the strip and continues to the edge 2, as in FIG. 4. Removal of material from the lower surface 11 causes the inside wall of the upper surface 16 to be exposed. The process of friction extraction on the inside wall further hardens the upper surface by stress-induced molecular change, enhancing the vibratory response of the reed.

Figure 3:
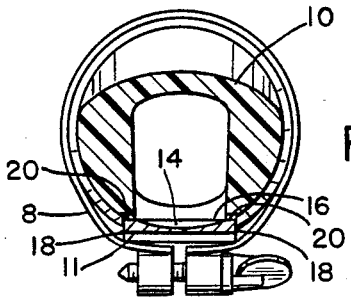
FIG. 3 is a cross-sectional view drawn on line 3—3.

A concave depression 14, as seen in FIGS. 2 and 3, is formed near the tongue 4 by a second friction extraction procedure. The friction extraction is preferably performed on the lower surface 11. Heat and stress produced during the friction extraction causes the metal to dimple downward, forming depression 14. The edges of the depression 14 are inset from the sides 18 of the reed 1 so that material which is thicker than that in the depression 14 remains, acting as a group of lateral supports 20. The group of supports 20 serves as a framework across which the thin material of the depression 14 is "stretched", providing the stress needed for vibration. The supports 20 also provide the springiness necessary to control pitch by varying pressure applied to the tongue 4.

The length and width of the supports 20, and where they begin relative to the tangent break 22 from the radial inlet 24 of the mouthpiece 10 effects the range differential of high register tones. The reed 1 is firmly fixed by ligature 8 to the appropriate portion of mouthpiece 10 in order to play the full register of the instrument.

The full-hard stainless steel reed of the present invention has a sufficient stiffness to simulate the vibratory response of cane reeds, thus providing the same tonal quality. The stainless steel is inert to body chemistry, easy to clean and disinfect and significantly less fragile than cane reeds. An additional advantage of the stainless steel reed is that it may be handled without risk of damage so that visually impaired musicians and music students can finally learn to play instruments requiring reeds.

It will be evident that there are additional embodiments which are not illustrated above but which are clearly within the scope and spirit of the present invention. The above description and drawings are therefore intended to be exemplary only and the scope of the invention is to be limited solely by the appended claims.

We claim:

1. A metal reed for wind instruments having a mouthpiece comprising:

a strip of full-hard stainless steel having an upper surface, a lower surface, a base end and a tongue end opposite said base end, said strip being tapered from the approximate lengthwise center toward said tongue end and having a generally concave depression in said tongue end.

2. A metal reed as in claim 1 wherein the edge of said tongue is rounded to match the edge of the mouthpiece of said wind instrument.

3. A metal reed as in claim 1 wherein said concave depression is formed by friction extraction of material from said lower surface, which forms a dimple in said upper surface.

4. A metal reed as in claim 3 wherein the perimeter of said concave depression comprises a plurality of supports whereby the amount of vibration of said reed is controlled.

5. A metal reed as in claim 1 wherein said full-hard stainless steel is hardened by cold-working.

6. A metal reed as in claim 1 wherein said full-hard stainless steel is hardened by pressure processing of paste metal.

7. A metal reed as in claim 1 wherein said full-hard stainless steel is hardened by high pressure molding of steel nuggets.

8. A metal reed as in claim 1 wherein said strip is progressively tapered by friction extraction of material from said lower surface.

9. A metal reed as in claim 2 wherein friction extraction comprises grinding.

10. A metal reed as in claim 2 wherein friction extraction comprises machine cutting.

11. A metal reed as in claim 2 wherein friction extraction comprises electro-discharge machining (EDM).

12. A metal reed as in claim 2 wherein which the fragile nature of cane reeds is eliminated thereby permitting use by vision impaired music students.

13. A method of producing a metal reed for wind instruments having a mouthpiece which comprises:

cutting a narrow strip of full-hard stainless steel having an upper surface, a lower surface, a base end and a tongue end;

forming a curved radius in said tongue end, said curved radius being shaped to match said mouthpiece;

forming a taper in said tongue end by friction extraction of material from said lower surface, said taper beginning at the approximate lengthwise center of said strip and progressing toward said curved radius; and forming a generally concave depression in said tongue end by friction extraction.

14. A method of producing a metal reed as in claim 13 wherein friction extraction comprises grinding.

15. A method of producing a metal reed as in claim 13 wherein friction extraction comprises machine cutting.

16. A method of producing a metal reed as in claim 13 wherein friction extraction comprises electro-discharge machining (EDM).

* * * * *